US009581321B2

(12) United States Patent
Peck et al.

(10) Patent No.: US 9,581,321 B2
(45) Date of Patent: Feb. 28, 2017

(54) LED LIGHTING APPARATUS WITH AN OPEN FRAME NETWORK OF LIGHT MODULES

(71) Applicant: Dialight Corporation, Farmingdale, NJ (US)

(72) Inventors: John Patrick Peck, Brielle, NJ (US); Kenneth Jenkins, Jackson, NJ (US); Samual David Boege, Point Pleasant, NJ (US)

(73) Assignee: Dialight Corporation, Farmingdale, NJ (US)

( * ) Notice: Subject to any disclaimer, the term of this patent is extended or adjusted under 35 U.S.C. 154(b) by 58 days.

(21) Appl. No.: 14/458,494

(22) Filed: Aug. 13, 2014

(65) Prior Publication Data

US 2016/0047538 A1 Feb. 18, 2016

(51) Int. Cl.

| | |
|---|---|
| ***F21V 29/76*** | (2015.01) |
| ***F21V 29/83*** | (2015.01) |
| ***F21S 2/00*** | (2016.01) |
| ***F21V 23/00*** | (2015.01) |
| *F21Y 101/00* | (2016.01) |

(52) U.S. Cl.

CPC ..... *F21V 29/763* (2015.01); *F21S 2/005* (2013.01); *F21V 23/009* (2013.01); *F21V 29/83* (2015.01); *F21Y 2101/00* (2013.01); *F21Y 2105/10* (2016.08); *F21Y 2115/10* (2016.08)

(58) Field of Classification Search

CPC ..... F21V 29/75; F21V 29/773; F21V 29/83; F21V 15/013; F21V 19/003–19/0055; H01L 33/644; H05K 7/20436; H05K 7/20445; F21S 2/005

See application file for complete search history.

(56) References Cited

U.S. PATENT DOCUMENTS

| | | | | |
|---|---|---|---|---|
| 3,220,471 | A | 11/1965 | Coe | |
| 6,530,683 | B1 | 3/2003 | Ohkohdo et al. | |
| 8,585,250 | B1 * | 11/2013 | Kim | F21V 29/004 165/80.3 |
| 2006/0133089 | A1 * | 6/2006 | Reid | F21L 4/00 362/294 |
| 2006/0181878 | A1 * | 8/2006 | Burkholder | F21S 48/321 362/294 |
| 2007/0247851 | A1 * | 10/2007 | Villard | F21K 9/00 362/294 |
| 2009/0129102 | A1 * | 5/2009 | Xiao | F21K 9/00 362/373 |
| 2009/0251898 | A1 * | 10/2009 | Kinnune | F21V 15/015 362/249.02 |
| 2010/0097799 | A1 * | 4/2010 | Shin | F21V 29/004 362/235 |
| 2010/0118496 | A1 | 5/2010 | Lo | |
| 2010/0309664 | A1 * | 12/2010 | Liu | F21S 2/005 362/235 |

(Continued)

OTHER PUBLICATIONS

International Search Report and Written Opinion of App No. PCT/US2015/044873 dated Nov. 4, 2015, pp. 1-11.

*Primary Examiner* — Anh Mai
*Assistant Examiner* — Steven Horikoshi

(57) ABSTRACT

The present disclosure is directed to a light emitting diode (LED) light module. In one embodiment, the LED light module includes a plurality of light sections and a plurality of open sections formed by a plurality of heat sink fins between the plurality of light sections, wherein each one of the plurality of light sections is adjacent to two different light sections of the plurality of light sections.

16 Claims, 8 Drawing Sheets

(56) References Cited

U.S. PATENT DOCUMENTS

| | | | | |
|---|---|---|---|---|
| 2011/0089830 | A1* | 4/2011 | Pickard | F21K 9/135 315/32 |
| 2011/0226458 | A1 | 9/2011 | Plonski et al. | |
| 2011/0317420 | A1* | 12/2011 | Jeon | F21S 2/005 362/249.02 |
| 2012/0085516 | A1* | 4/2012 | McClellan | F21V 15/013 165/80.3 |
| 2013/0020462 | A1* | 1/2013 | Kim | F21K 9/13 250/205 |
| 2014/0021884 | A1 | 1/2014 | Fetterly et al. | |
| 2014/0029260 | A1* | 1/2014 | Liu | F21V 21/00 362/249.02 |
| 2014/0098542 | A1 | 4/2014 | Zimmer et al. | |

* cited by examiner

LED LIGHTING APPARATUS WITH AN OPEN FRAME NETWORK OF LIGHT MODULES

BACKGROUND

Lighting accounts for a large percentage of the world's total energy usage. Currently, the trend is to move towards lighting that employs light emitting diodes (LEDs) as they are more efficient, last longer and are more shock and vibration resistant. However, like other light sources LEDs create a significant amount of heat that must be dissipated since LEDs cannot operate at very high temperatures like traditional light sources.

Current LED lighting designs generally approach the thermal problem by adding heatsink fins on and around the housing. Some previous designs simply attach multiple light fixtures together to achieve high light output. However, this ex post facto design leads to large and bulky light fixtures that are very heavy because the heat is dissipated primarily by air flow through convection around the outside of the light fixture where the fins are located.

In addition, the heat sink fins are typically extended out further radially for light fixtures that produce more light output and, therefore, dissipate more power and heat generated by the LEDs. However, extending the heat sink fins out further radially moves the heat dissipating surface area further away from the LEDs. The additional distance away from the LED heat source results in a higher thermal resistance between the LEDs and the outside air and, therefore, less effective use of the heat sink fins and ultimately higher LED junction temperatures.

SUMMARY

In one embodiment, the present disclosure provides a light emitting diode (LED) light module. In one embodiment, the LED light module comprises a plurality of light sections, wherein each one of the plurality of light sections comprises a plurality of heat sink fins on an outside of each one of the two or more lateral sides from an outer side to an inner side, a plurality of heat spreader fins on an inside of each one of the two or more lateral sides from the outer side to the inner side, a compartment formed by the two or more lateral sides, the outer side and the inner side and a plurality of light emitting diodes (LEDs) inside the compartment, wherein the compartment is sealed from outside air and encloses the plurality of LEDs and a plurality of open sections formed by the plurality of heat sink fins between the plurality of light sections, wherein each one of the plurality of light sections is adjacent to two different light sections of the plurality of light sections.

In one embodiment, the present disclosure provides another embodiment of a lighting apparatus. In one embodiment, the lighting apparatus comprises a center housing and a plurality of modular light sections coupled to the center housing and to one or more other ones of the plurality of modular light sections, each one of the plurality of modular light sections comprising an inner side, an outer side, a first lateral side and a second lateral side coupled to the inner side and the outer side, a plurality of heat sink fins formed on an outside of the first lateral side and the second lateral side, a plurality of heat spreader fins formed on an inside of the first lateral side and the second lateral side, a plurality of light emitting diodes (LEDs) inside a compartment formed by the inner side, the outer side, the first lateral side and the second lateral side and on the plurality of heat spreader fins and an interlocking feature on the first lateral side and on the second lateral side.

In one embodiment, the present disclosure provides a light module for connecting to other light modules to form a lighting apparatus. In one embodiment, light module comprises a plurality of heat sink fins on an outside of each one of two or more lateral sides, a plurality of heat spreader fins on an inside of the each one of the two or more lateral sides, an inner ledge formed by the plurality of heat spreader fins along an inner perimeter of the two or more lateral sides, a printed circuit board (PCB) comprising one or more light emitting diodes (LEDs), wherein the PCB is placed on the inner ledge, an optically clear cover coupled perpendicular to a first vertical end of the plurality of heat sink fins over the PCB and the one or more LEDs such that the one or more LEDs emit light towards the lens and a back plate coupled perpendicular to a second vertical end of the plurality heat sink fins that is opposite the first end.

BRIEF DESCRIPTION OF THE DRAWINGS

So that the manner in which the above recited features of the present disclosure can be understood in detail, a more particular description of the disclosure may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

As discussed above, current designs for high powered lighting applications (e.g., LED light fixtures capable of replacing 1000 Watt (W) traditional light fixtures) use existing LED thermal management designs such as long and extended protrusions that act as heat sink fins on and around the enclosure of the light. As a result, the light fixtures are large and heavy. For example, the existing thermal management designs employ many heat sink fins that are very long in order to dissipate heat away from the LED light sources. Due to the large size and weight, these ex post facto designs result in light fixtures that are difficult to handle and install due to their large size and weight. As a result, the light fixtures on the market today often require more than one person to install. This increases the installation costs significantly, as well as the costs associated with shipping, packaging, handling and other overhead costs.

One embodiment of the present disclosure addresses the need for high powered lighting applications by providing a unique design that is small, light weight and designed to more efficiently dissipate heat generated by the LEDs compared to the existing LED light fixtures. In other words, the present design does not simply consist of a housing and heatsink fins that extend outward from the housing. The embodiments of the present disclosure have more efficient cooling of the LEDs by creating an open air arrangement, or frame network, where air flows through the light fixture and not just around the outside of the light fixture. For example, the air may rise and pass very closely to each of the LEDs.

Figure 1:
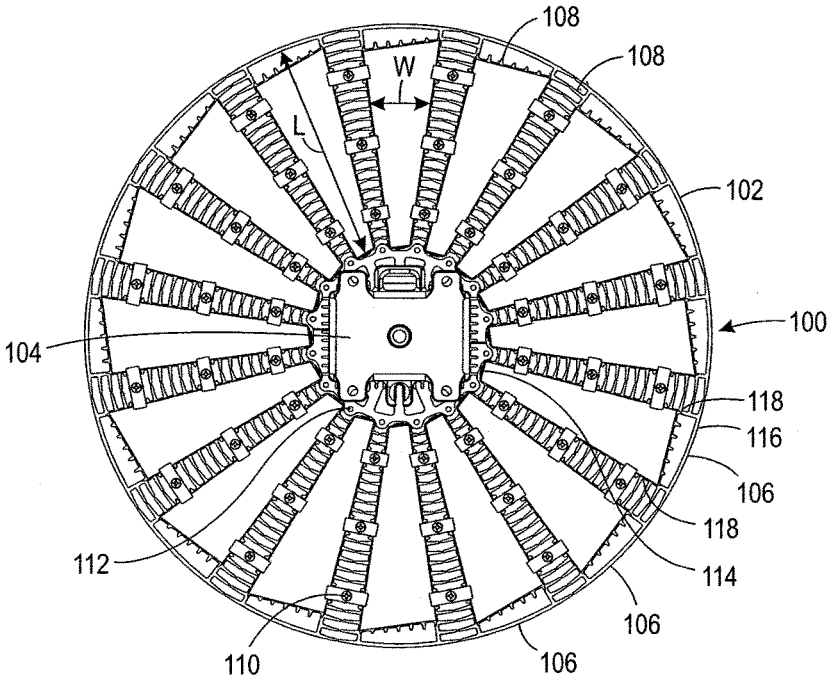
FIG. 1 depicts a top view of one embodiment of a lighting apparatus.

FIG. 1 illustrates one embodiment of a light apparatus 100 of the present disclosure capable of producing a high light output. The light apparatus 100 may include a center housing 104 and an LED light module 102 coupled to the center housing 104. In one embodiment, the center housing 104 may have a column shape and be used to house a power supply. In one embodiment, the center housing 104 may be used to house a single power supply, illustrated in FIG. 6, that powers all of the light emitting diodes (LEDs), illustrated in FIG. 7. In one embodiment, the center housing 104 may be used to house additional components, such as for example, additional power supplies or electronics. The center housing 104 may take various forms, such as for example, an enclosure in the shape of a square or round.

In one embodiment, the LED light module 102 may be generally circular in shape having a center opening that is coupled to a base of the center housing 104. However, it should be noted that the LED light module 102 may include other shapes (e.g., a square, a rectangle, a polygon having an even number of sides, and the like). In one embodiment, the LED light module 102 may be symmetrical in shape. This may allow the fixture to be more balanced when hanging. One or more mechanical fasteners 112 may be used to couple the LED light module 102 to the center housing 104 via one or more corresponding openings. For example, a bolt, nut, rivet, screw, and the like, may be used to couple the LED light module 102 to the base of the center housing 104.

In one embodiment, the LED light module 102 may comprise a plurality of light sections 106. In one embodiment, the LED light module 102 may include six or more light sections 106 to achieve the high light output. As discussed above, the light sections 106 may be arranged to form a shape such as a circle or a square. For example, each one of the light sections 106 of the LED light module 102 may be adjacent to at least two other light sections 106 to form a closed loop or shape.

Figure 10:
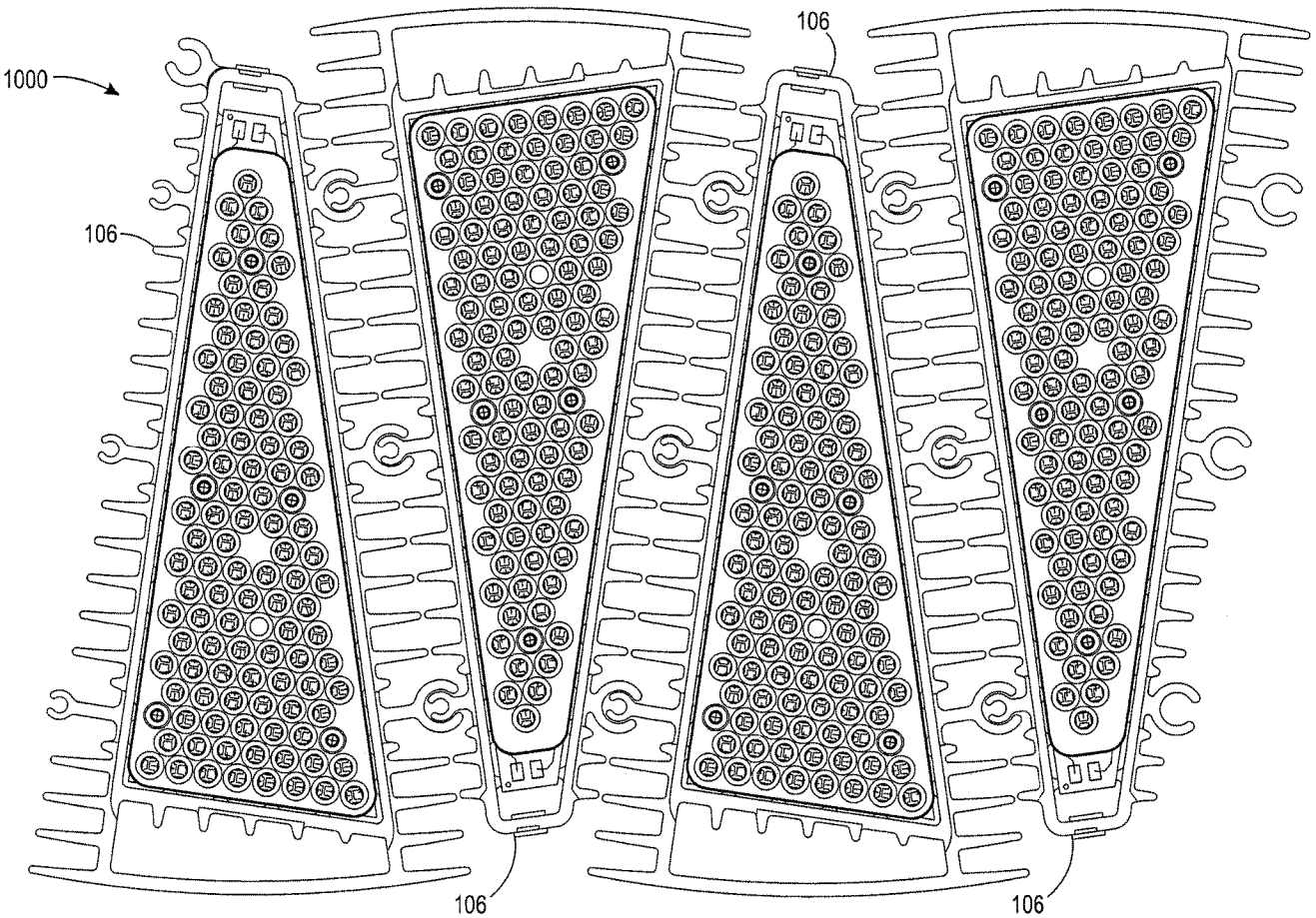
FIG. 10 depicts one embodiment of a linear arrangement of the modular light sections.

However, additional light sections 106 such as smaller light sections may be used to augment the LED light module 102. These additional light sections 106 may not necessarily be adjacent to at least two other light sections 106. In another embodiment, the light sections 106 may be arranged in a linear fashion as illustrated in FIG. 10. FIG. 10 shows only four light sections 106 in order to illustrate a linear arrangement. In one embodiment, six or more modular light sections 106 are arranged in a linear fashion. In one embodiment, six or more modular light sections 106 are arranged along a straight line. For example, the modular light sections 106 may be connected linearly or side-by-side in a line. In one embodiment, each one of the modular light sections 106 may be coupled to exactly or only two other modular light sections 106 on each side. In other words, each one of the modular light sections 106 may be directly formed next to or coupled to an adjacent modular light section 106 on each side (e.g. an adjacent modular light sections 106 on a left side and an adjacent modular light sections 106 on a right side).

Each one of the plurality of light sections 106 may be separated by a plurality of heat sink fins 108 that may be arranged generally perpendicular (within +/−3 degrees) to each lateral side 118 from an inner side 114 to an outer side 116 of each one of the plurality of light sections 106. The heat sink fins 108 provide significant convection of heat to the outside air in the ambient environment. In other words, the heat sink fins 108 are located along a length of the lateral sides 118 beginning from an end adjacent to the inner side 114 to an opposite end adjacent to the outer side 116.

In one embodiment, the heat sink fins 108 may have various shapes. For example, the heat sink fins may be straight, curved, angled or may branch out in a tree shape.

In one embodiment, the plurality of light sections 106 may form an open frame network that provides large amount of open volume adjacent to at least three sides of each one of the plurality of light sections 106. These open volumes may also be referred to as open spaces. In one embodiment, the open frame network allows a majority of the perimeter of the light sections 106 to be exposed to open air and allows the open air to pass. The term "open" or "open air" may be defined as air outside of the LED light 102. The passing air may cool the light sections 106 via convection. In one embodiment, the majority of the perimeter may be defined 80% or more of the perimeter. As a result, the light apparatus 100 may allow large amounts of air to flow through LED light 102 and, therefore, very efficiently dissipate the heat generated by the LEDs.

In one embodiment, the cumulative total area of the open sections between the plurality of light sections 106 formed by the heat sink fins 108 between the lateral sides 118 of the two adjacent light sections 106 may be 50% or less of the total cumulative area of the light sections. In one embodiment, the average width of the open sections between the plurality of light sections 106 is greater than 0.2 of the average width of the light sections 106. In one embodiment, the average width of the open sections between the plurality of light sections 106 is less than twice of the average width of the light sections 106. In other words, the average width of the open sections between the plurality of light sections 106 is less than two times of the average width of the light sections 106. For example, the width may be a distance between the lateral sides 118 of the light sections 106 as illustrated by a line "w" illustrated in FIG. 1.

In one embodiment, the light sections 106 may be rectangular. In one embodiment, the light sections 106 may be long and narrow. Making the light sections 106 narrow in one axis ensures that the LEDs are close to sink fins 108. Making the light sections 106 long in one axis makes the assembly more reasonable because it keeps the number of light sections 106 to a minimum. In one embodiment, the average length of the light sections 106 is greater than the average width of the light sections 106. In one embodiment the average length of the light sections 106 is at least two times more than the average width of the light sections 106. In one embodiment, the length may be a distance between the inner side 114 and the outer side 116 as illustrated by a line "L" in FIG. 1.

However, the light sections 106 may have a triangular shape that generally increases wider as the light sections 106 are radially extended outward (e.g., outward along the line L). That is to say that the general width may increase as the light sections 106 are radially extended outward. Thus, the average width may be an average of all widths between the lateral sides 118 or simply the width at center of the lateral sides 118. In one embodiment, the light sections 106 may be non-square. In one embodiment the light sections 106 may be rectangular.

The open frame network may serve a number of functions. One function may be to create high structural rigidity while minimizing weight. The lateral sides 118 create very strong wall sections for support. Another function may be to house the LEDs (discussed below). Yet another function may be to conduct heat away from the LEDs and then dissipate the heat through convection and radiation. The open frame network eliminates the housing that is typically used to enclose the LEDs and associated components. That is to say that the lateral sides 118, an optically clear cover 182, and a back plate 180 enclose the LEDs and associated components. This results in a very significant reduction of size, weight and cost.

In one embodiment, the inner side 114 and the outer side 116 may be curved in accordance with a radius of curvature of the overall circular radius of the light apparatus 100. In one embodiment, the outer side 116 may have a larger radius than the inner side 114 measured from a center of the center housing 104 to the inner side 114 and the outer side 116. In one embodiment, the inner side 114 and the outer side 116 may be straight. In one embodiment, the outer side 116 may have a larger width than the inner side 114.

Figure 8:
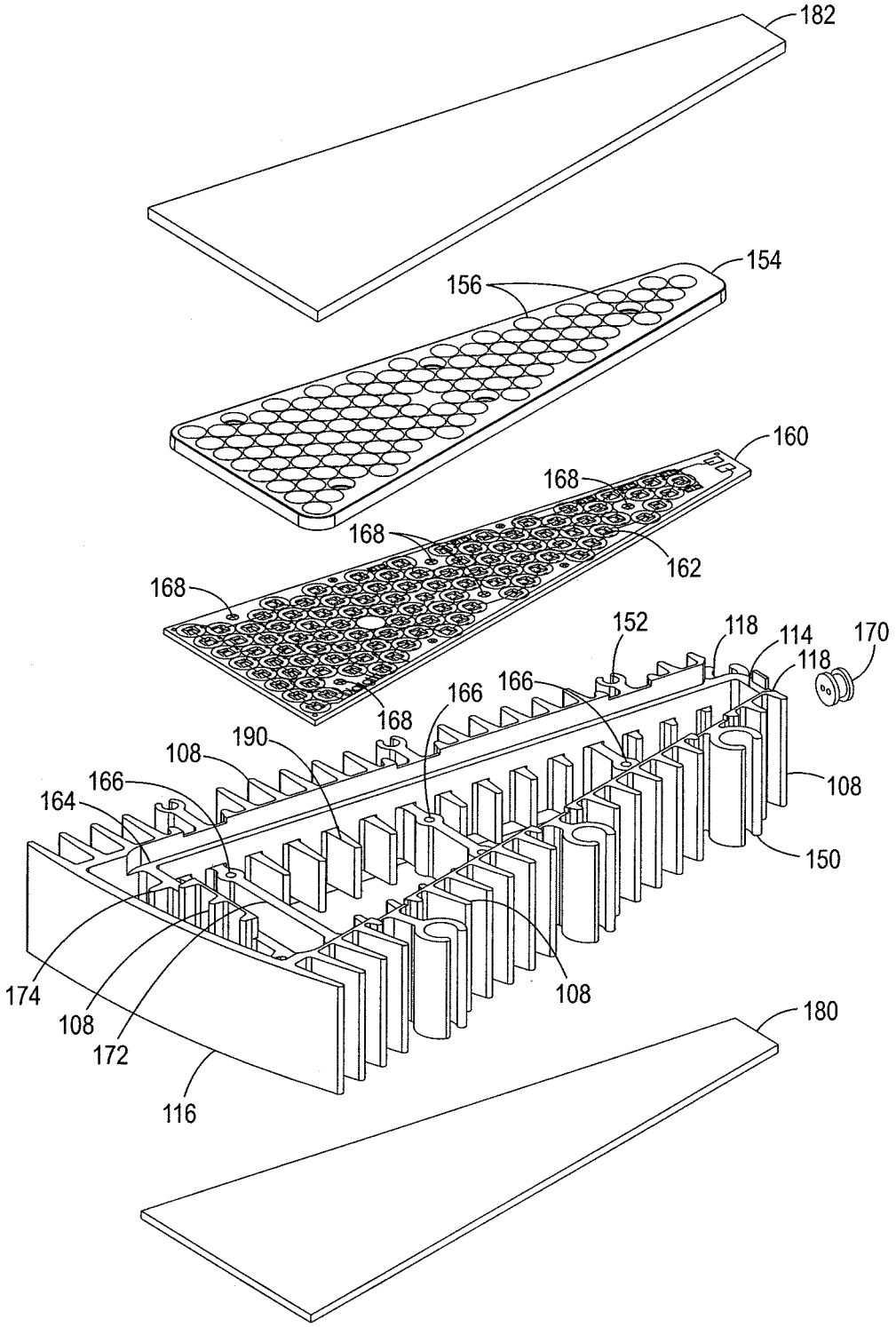
FIG. 8 depicts an exploded view of one embodiment of the modular light section.

Notably, the design of the light apparatus 100 maximizes the surface area of the plurality of heat sink fins 108. By using an open frame network, the heat sink fins 108 may be placed along the outer side of the lateral sides 118 and/or the inner sides of the lateral sides 118, as illustrated in FIG. 8 and discussed below. As a result, each one of the heat sink fins 108 are in close proximity to the LEDs. This minimizes the thermal resistance between heat sink fins 108 and the LEDs, therefore, resulting in cooler LED operating temperatures. The height of the heat sink fins 108 and lateral side 118 can be increased or decreased to adjust the amount of total outer surface area needed to dissipate the heat. In a preferred embodiment, the LEDs are close to the end of the end edge surface of the lateral sides 118. For example, the average distance of the LEDs to end edge surface of the lateral sides 118 is less than 20% of the total average height of the lateral sides 118. In one embodiment, the average distance of the LEDs to a top cover 132 of the lateral sides 118 is less than 20% of the total average height of the lateral sides 118. The open frame design allows air to freely move through the LED light module 102. The heatsink fins 108 will warm the air and cause it to rise upward and draw cool air from below the LED light module 102 to rise upward and through the LED light module 102. This "chimney effect" results in for maximum cooling. The end result is a smaller and very lightweight mechanical design.

In contrast, current LED light fixture designs attempt to increase the heat dissipation by simply extending the heat sink fins radially outward from a single housing. Although the surface area can be added by simply extending the heat sink fins further and further, the distance of the added surface area from the LEDs is far and the efficiency of the heat removal is significantly reduced. This is because the thermal resistance between the LEDs and the added material is higher since the material is further away from the LEDs. In other words, the present design increases the surface area of the heat sink fins 108, while keeping the plurality of heat sink fins 108 and the associated surface to the LED light sources very close to each other. Again, this results in a significant reduction of size and weight.

In one embodiment, the plurality of light sections 106 may be modular. In other words, the LED light module 102 may comprise a plurality of modular light sections 106. For example, a modular light section 106 may be coupled separately to another modular light section 106. The modular light sections 106 may also be coupled to a common part such as the center housing 104. Said another way, the modular light section 106 may be considered a section or a "slice" of the LED light module 102. In one embodiment, the light sections 106 may be independently removable. For example, if one or more LEDs fail in one of the plurality of modular light sections 106, then the modular light section 106 having the failed LED may only need to be replaced. The entire LED light module 102 need not be replaced. Said yet another way, the modular light sections 106 may be assembled to the center housing 104 in a hub and spoke fashion.

For example, each one of the modular light sections 106 may be coupled such that each heat sink fin 108 along a respective lateral side 118 is aligned. The aligned heat sink fins 108 may create open spaces between each one of the modular light sections 106, which may provide for maximum airflow up and around the modular light sections 106 to remove the heat that is transferred along the heat sink fins 108. An interlocking feature, illustrated in FIGS. 7 and 8 below, and a mechanical fastener 110 may be used to couple a modular light section 106 to other modular light sections 106. In one embodiment, the mechanical fastener 110 may be a bolt, nut, rivet, screw, and the like.

In one embodiment, each one of the modular light sections 106, the heat sink fins 108 and the heat spreader fins (discussed below) may have a generally constant and projected cross section in at least one axis as shown in FIG. 8. That is to say that the modular light sections 106 may have a very straight or linear form. In one embodiment, the constant cross section of the heat sink fins 108 and the heat spreader fins may be oriented in an axis parallel to a central light output axis. In one embodiment, the central light output axis may be defined as the central axis of light concentration. For example, the central light output axis of each modular light section 106 may be illustrated as coming into or out of the page in FIGS. 1 and 2 or pointing vertically downward in FIGS. 3 and 4. This is often called the nadir. In one embodiment, parallel has a tolerance of +/−3 degrees. In one embodiment, perpendicular has a tolerance of +/−3 degrees. In one embodiment, the plurality of heat sink fins 108 and the plurality of heat spreader fins (discussed below) have a constant and projected cross section axis that is parallel to the central light output axis to within +/−3 degrees.

Figure 2:
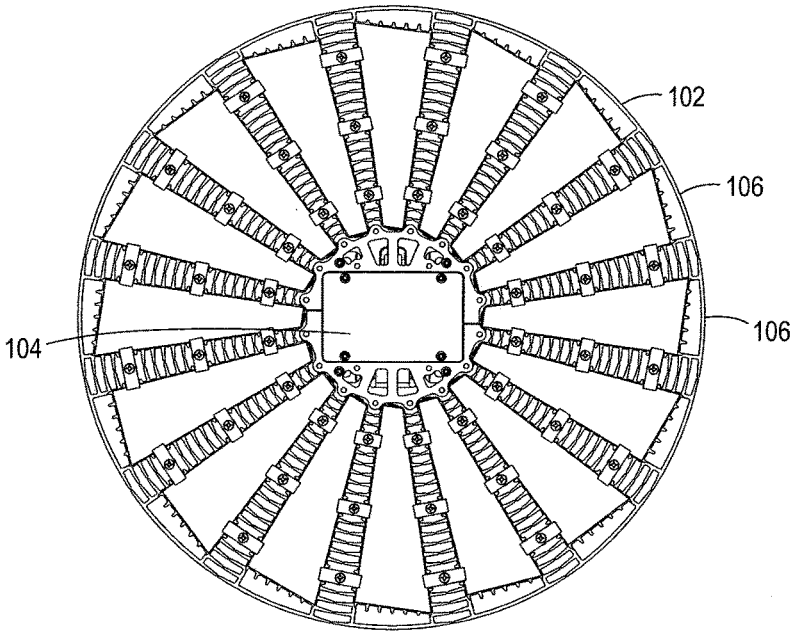
FIG. 2 depicts a bottom view of one embodiment of the lighting apparatus.

A very consistent cross section provides for maximized air flow and cooling because the air may move smoothly and unimpeded past the modular light sections 106. For example, and as shown in FIG. 2, the LED light 102 would typically be oriented in use so that the projected cross sections are vertical and the air could freely pass upward vertically through the open sections. In one embodiment, the lateral sides 118 are generally straight and have an average draft angle of less than six degrees. In one embodiment, the heat sink fins 108 are generally straight and have an average draft angle of less than six degrees. In one embodiment, a majority of the heat sink fins 108 may have an average draft angle of less than six degrees. In one embodiment, a majority may be defined as being greater than 50% of the total number of heat sink fins 108.

In one embodiment, the specific features of the heat sink fins 108 may be achieved via an extrusion process. Draft angles on the heat sink fins from the casting process may inhibit air flow, which reduces the ability of the heat sink fins to transfer heat away from the LEDs.

In one embodiment, each one of the modular light sections 106 may be designed to form the open frame network of the LED light module 102. For example, none of the heat sink fins 108 along the outer lateral sides 118 are blocked by any portion of the center housing, housing, power supplies, etc. The open frame network of heat sink fins 108 creates a many open areas in the lighting apparatus to promote air flow up, around and through the heat sink fins 108 in an uninhibited fashion to help transfer heat away from the LEDs, as noted above.

In addition, the LED light module 102 may have symmetrical shape, e.g., a circular shape. The symmetrical shape allows easier alignment of the light apparatus 100. However, when installing a run of rectangular lights or other non-symmetric shapes, it would be difficult to perfectly align each light engine. In contrast, a single unitary symmetrical design for producing a high light output removes any alignment issues and provides an even light distribution during installation.

Another advantage of the present circular design of the light apparatus 100 is that the light apparatus 100 may be easily scaled to include more LEDs with a corresponding amount of heat sink fins 108 as lighting applications require more light. For example, more LEDs may be added in each light section 106 radially outward. As the light sections 106 are extended radially outward, the lateral sides 118 are also extended, thereby, allowing additional heat sink fins 108 to be added on the extended surface of the lateral sides 118.

Notably, the added heat sink fins 108 are still close to the LED light sources that are added. In contrast, previous designs could not accommodate additional heat sink fins as LEDs were added. Rather, the previous designs required that the length of the heat sink fins were simply extended further away from the LED light source. However, the heat sink material that is further away from the LED light source cannot lower the LED temperature as effectively as the heat sink material that is closer to the LEDs.

Figure 3:
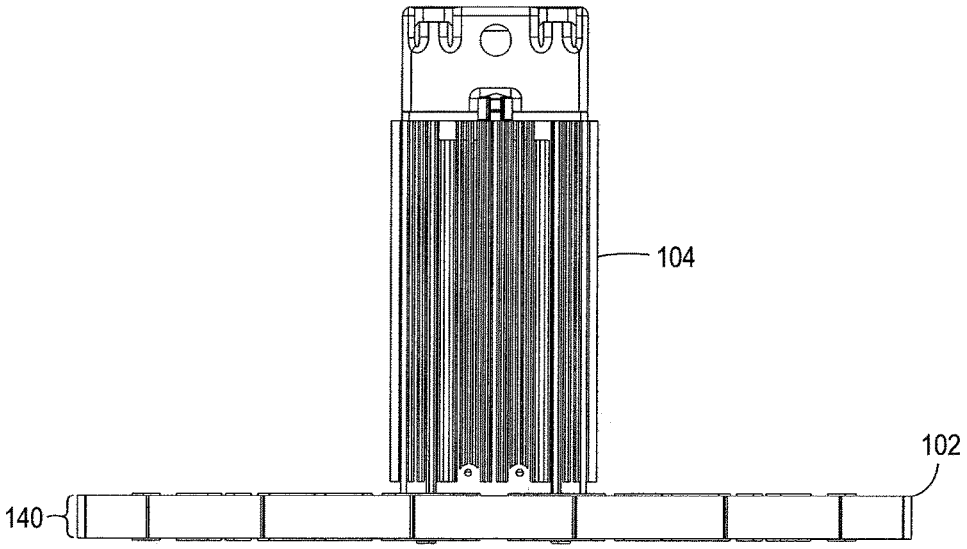
FIG. 3 depicts a first side view of one embodiment of the lighting apparatus.
Figure 4:
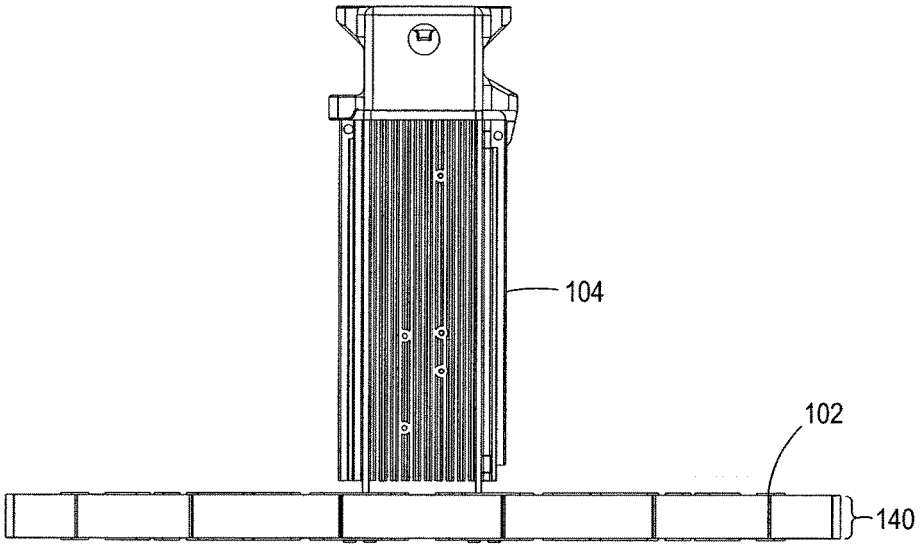
FIG. 4 depicts a second side view of one embodiment of the lighting apparatus.
Figure 5:
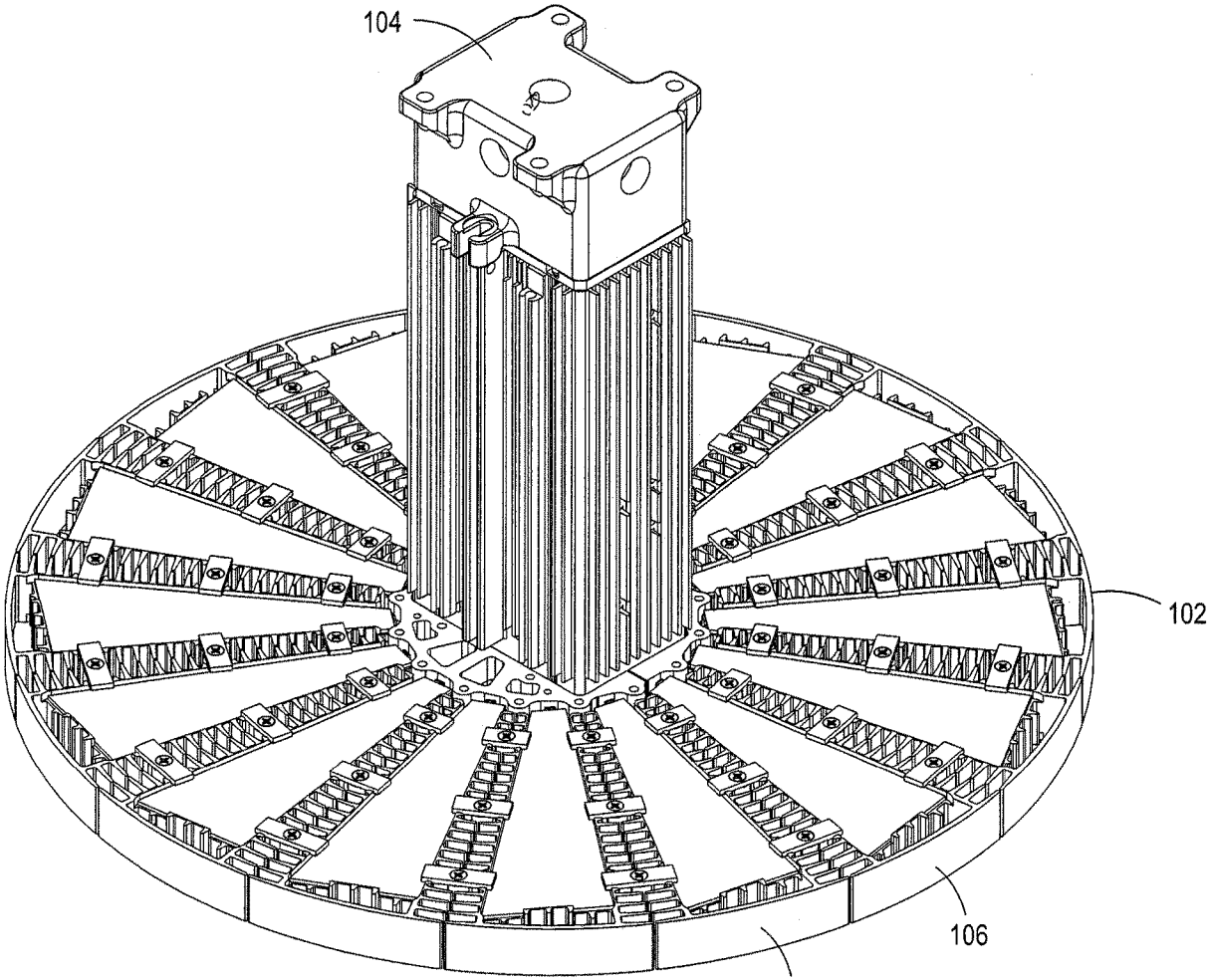
FIG. 5 depicts an isometric top view of one embodiment of the lighting apparatus.

FIG. 2 illustrates an example bottom view of the light apparatus 100. FIG. 3 illustrates an example side view of the light apparatus 100 showing a front of the center housing 104. FIG. 4 illustrates an example side view of the light apparatus 100 showing a back of the center housing 104. FIG. 5 illustrates an isometric top view of the light apparatus 100.

In one embodiment, a height 140 of each one of the light sections 106 as illustrated in FIGS. 3 and 4 may be adjusted to achieve a desired amount of heat dissipation to ensure a lower operating temperature of the LEDs. For example, more heat may be dissipated by the heat sink fins 108 as the height 140 of the heat sink fins 108 is increased with the light sections 106. Notably, increasing the height of the heat sink fins 108 creates more surface area for the heat sink fins 108, while maintaining a close proximity to the LEDs. In contrast as discussed above, previous designs that increase the surface area of heat sink fins radially outward provide less efficient heat dissipation while adding significant weight and size to the light engine.

Figure 6:
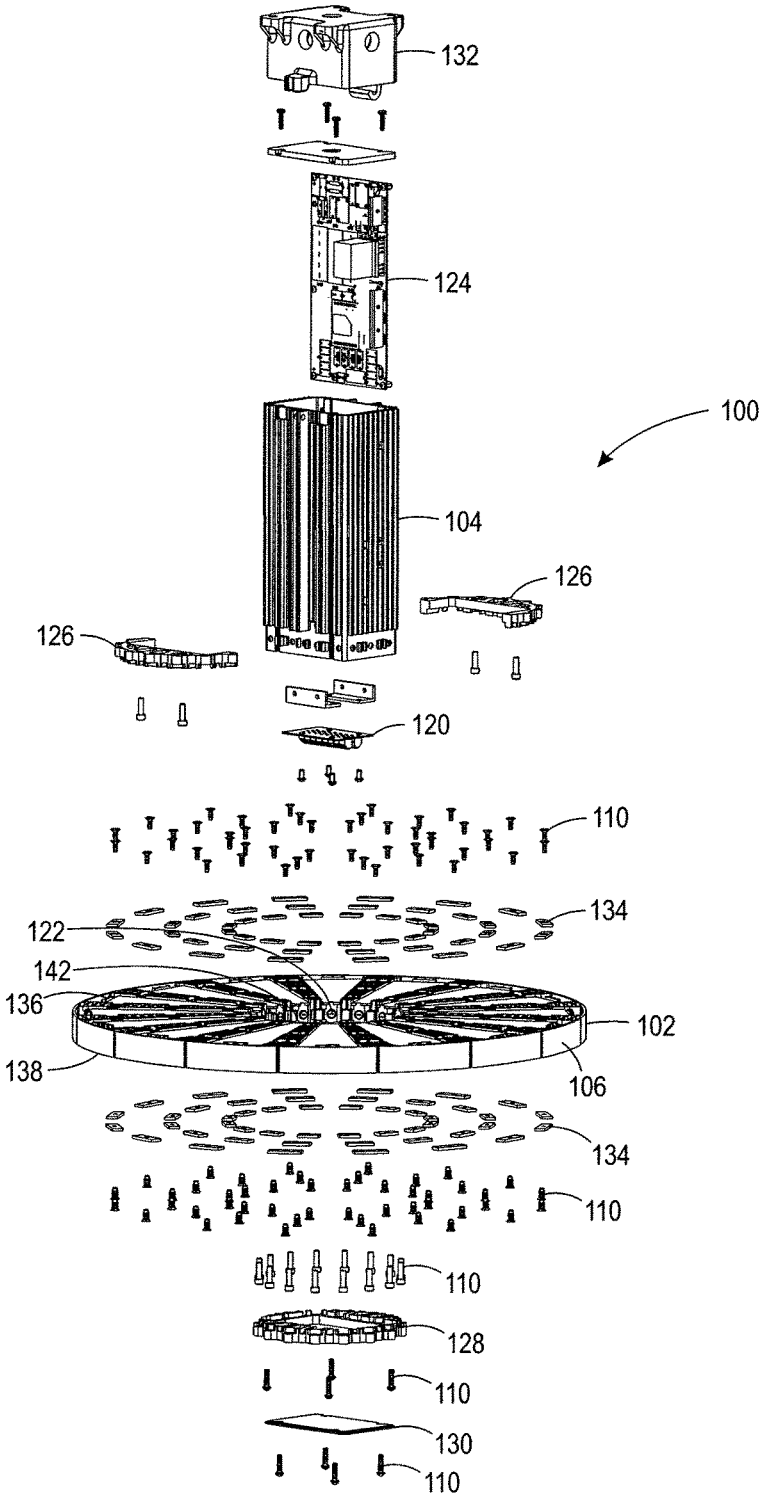
FIG. 6 depicts an exploded view of one embodiment of the lighting apparatus

FIG. 6 illustrates an example exploded view of the light apparatus 100. As discussed above, the light apparatus 100 may comprise a single power supply 124. In one embodiment, the power supply 124 may comprise a power supply capable of providing at least 500 Watts (W) of power. The single power supply 124 may be used to power each one of the LEDs of each one of the light sections 106.

As discussed above, using a single power supply 124 provides advantages over using multiple power supplies of a lower Wattage. For example, the light apparatus 100 may be lighter and may be smaller. As a result, it may be easier to handle the light apparatus 100. As a result of the smaller size and lighter weight, the light apparatus 100 may also be easier to install.

In one embodiment, the power supply 124 may be housed or contained in the center housing 104 and sealed with a top cover 132. The center housing 104 may also include wire connection hardware 120. The wire connection hardware 120 may provide an easy way to connect each circuit board of each light section 106 to the power supply 124.

For example, each one of the light sections 106 of the LED light module 102 may include an opening 122 at an inner side 114 to allow wiring from the light section 106 to pass through to the center housing 104. The wiring from each one of the light sections 106 may be connected to the wire connection hardware 120. A single wire from the wire connection hardware 120 may then be connected to the power supply 124. As a result, if the power supply 124 fails only a single wire will need to be disconnected and reconnected. Without the wire connection hardware 120, if the power supply 124 failed, then multiple wires from each one of the light sections 106 would need to be disconnected and reconnected to replace the power supply 124.

In one embodiment, a top hub 126 may be coupled to the center housing 104 and a top side 136 of the LED light module 102. The top hub 126 may be a single piece or multiple pieces as illustrated in FIG. 6. A bottom hub 128 may also be coupled to a bottom side 138 of the LED light module 102 or a side opposite the side that is coupled to the top hub 126. As a result, the top base 126 and the bottom hub 128 may "clamp" or "sandwich" the LED light module 102 via one or more associated mechanical fasteners 110, as illustrated in FIG. 6. A bottom plate 130 may be used to seal a center opening 142 of the LED light module 102 that is coupled to the center housing 104. In one embodiment, the top hub 126 and/or the bottom hub 128 may have a "wire-way" channel or channels to route the wires that connect the plurality of light sections 106 to the center housing 104.

It should be noted that although the center housing 104, the top cover 132, the top hub 126 and the bottom hub 128 are illustrated as separate pieces, it should be noted that the center housing 104, the top cover 132, the top hub 126 and the bottom hub 128 may be formed as a single unitary piece. In other words, the center housing 104, the top cover 132, the top hub 126 and the bottom hub 128 may be formed a single integral unit.

FIG. 6 also illustrates one or more plates 134 and one or more mechanical fasteners 110 that are used when the LED light module 102 comprises the plurality of modular light sections 106 described above. That is, when the light sections 106 comprise modular sections the plates 134 and the mechanical fasteners may be used to clamp adjacent lateral sides 118 of adjacent modular light sections 106. In other words, one or more plates 134 may be used on a top side 136 and a bottom side 138 (e.g., opposing sides) of adjacent modular light sections 106 and secured with a mechanical fastener 110 to couple the modular light sections 106 together.

Figure 7:
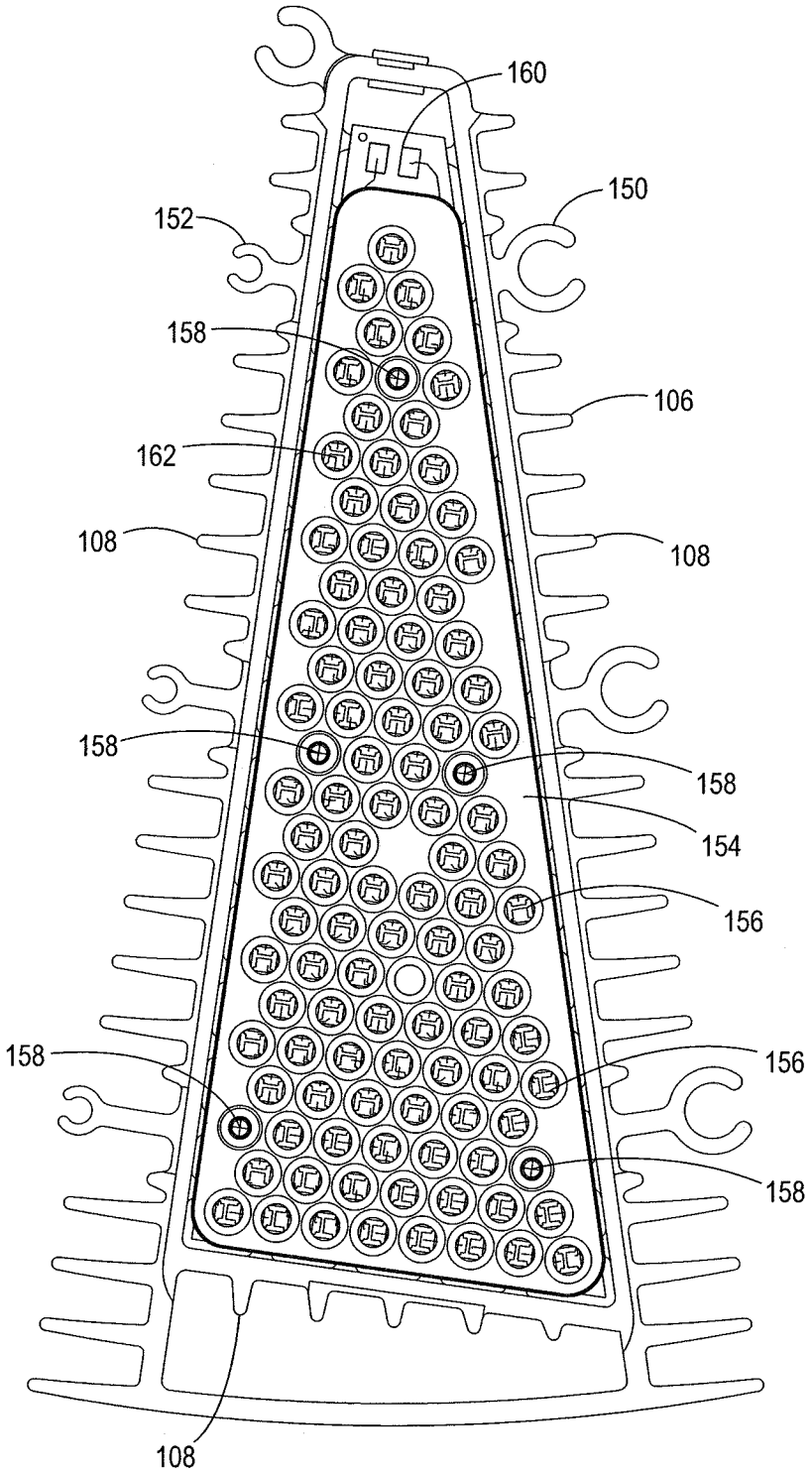
FIG. 7 depicts a top view of one embodiment of a modular light section.

FIG. 7 illustrates a top view of one embodiment of the modular light section 106. FIG. 8 illustrates an exploded view of one embodiment of the modular light section 106.

FIG. 7 and FIG. 8 may be referred to in describing the details of the modular light section 106.

In one embodiment, the modular light section 106 may include a printed circuit board (PCB) 160 having one or more LEDs 162. It should be noted that the PCB 160 may comprise a common circuit board material such as FR4 or a metal core circuit board but may also comprise other plate material with circuit traces or wire connection as an example. The PCB 160 may also comprise a combination of materials such as a common PCB material in combination with a plate material. The plate material may be metal or other thermally conductive material such as thermally conductive plastic or graphite for example. The modular light section 106 may also include an optic layer 154 having one or more reflector cups 156 that correspond to each one of the one or more LEDs 162.

Notably, the design of the modular light section 106 allows for an open frame network for air to pass through the light for better cooling of the LEDs 162. In addition, the design of the modular light section 106 moves the LEDs 162 from a center to an outer periphery of the light apparatus and radially outward via the plurality of modular light sections 106. In other words, the LEDs 162 are concentrated outside the center area of the LED light 102. In one embodiment, the LEDs 162 are concentrated beyond the center 10% area of the LED light 102. This provides a light apparatus that may be scalable to added LEDs 162 and heat sink fins 108 to produce a higher lumen light output. Typically, current LED light engine designs locate the LEDs in a main housing of the light engine and surround the center housing of LEDs by heat sink fins. Thus, scaling the light engine to add more LEDs and heat sink fins is difficult.

In one embodiment, the optic layer 154 may be fabricated from a reflective material (e.g., a mirror, a metal having reflective mirror, a plastic with a reflective surface, and the like). In one embodiment, the optic layer 154 may be fabricated from any material and only the reflector cups 156 may have a reflective material (e.g., a reflective mirror, plastic or metal). In one embodiment, the PCB 160 and the optic layer 154 may be cut in a shape having at least one right angle (i.e., a 90 degree corner). In one embodiment, the shape may be a right triangle, a truncated triangle, a rectangle, a hexagon, an octagon, a polygon with two right angles, and the like.

As illustrated in FIG. 8, the modular light section 106 may have a skeletal frame design that creates an open frame network when an array of modular light sections 106 are coupled together. The modular light sections 106 may have a ledge 164 and an inner ledge 172 feature. The lateral sides 118 and the inner side 114 may have at least one right triangle shape. The ledge 164 and the inner ledge 172 may have at least one right triangle shape. The ledge 164 may be formed along an inside perimeter of the lateral sides 118 and the inner side 114. The inner ledge 172 may be formed along an inside perimeter of the lateral sides 118, the inner side 114 and one or more heat spreader fins 190 located on an inside of the lateral sides 118.

In one embodiment, the heat spreader fins 190 may be protrusions from the inside of the lateral side 118 towards a center of the modular light section 106. In one embodiment, each lateral side 118 may have heat spreader fins 190 on an inside. In one embodiment, the heat spreader fins 190 may protrude from one lateral side 118 across to the opposite lateral side 118. In other words, the heat spreader fins 190 may protrude across the inside from one lateral side 118 to the other lateral side 118. In one embodiment, the heat spreader fins 190 may terminate or end without touching the other lateral side 118.

The heat spreader fins 190 may conduct heat laterally along a length of the heat spreader fin 190 towards the lateral side 118 and vertically through a height of the lateral side 118. The heat spreader fins 190 conduct heat generated from the LEDs 162 located towards a center of the PCB 160 away from the LEDs 162 and towards the lateral sides 118. Then the heat may be removed via convection created by air passing over the heat sink fins 108 on the outside of the lateral side 118.

The modular light sections 106 may each have at least one compartment. The compartment may be an internal volume or open space formed by the enclosure of the lateral sides 118, the inner side 114, the outer side 116, the back plate 180, and the optically clear cover 182. This results in a sealed compartment capable of keeping out moisture, dust, and other foreign material.

In one embodiment, the heat sinks 108 on the inside of the lateral sides 118 may provide a support surface as part of the inner ledge 172 for the PCB 160 and the optic layer 154. In addition, the heat sinks 108 on the inside of the lateral sides 118 and a cross bar of the inner ledge 172 may be used to dissipate heat from LEDs 162 located at a center of the PCB 160. For example, without the heat sinks 108 on the inside of the lateral sides 118 and/or the cross bar of the inner ledge 172, the LEDs 162 at the center of the PCB 160 would operate at a much higher temperature causing the LEDs 162 at the center of the PCB 160 to operate improperly or cause a potential failure.

Figure 9:
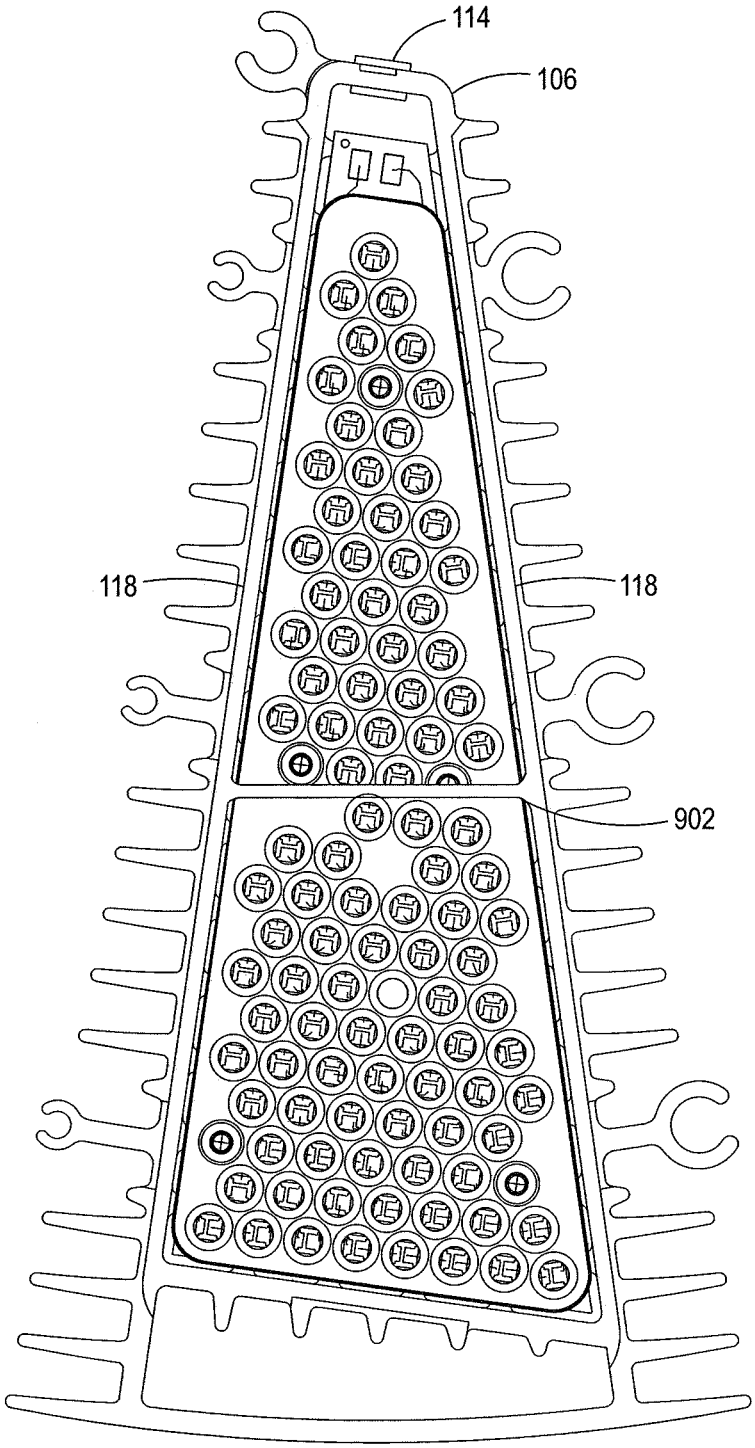
FIG. 9 depicts a top view of one embodiment of a modular light section with a divider having multiple compartments.

The optically clear cover 182 and the back plate 180 may be used to cover and/or seal the PCB 160 and the optic layer 154 via a ledge 164. In one embodiment, the optically clear cover 182 and the back plate 180 may be coupled to perpendicularly or at 90 degrees to a top vertical end and a bottom vertical end of the heat sink fins 108, as illustrated by FIGS. 7 and 8. The wires that connect to the LEDs may be sealed with a component such as a grommet or other wire seal 170. In one embodiment, the back plate 180 may be flush or even with an end edge surface of the lateral sides 118 and the outer side 116 and the optically clear cover 182 may be flush or even with an end edge surface of the lateral sides 118 and the outer side 116 opposite of the edge of the back plate 180. As a result, dust, debris and liquids can be prevented from collecting on recessed areas of the modular light section 106. In one embodiment, a modular light section 106 may have two or more optically clear covers 182, back plates 180, and PCBs 160. That is to say that a modular light section 106 may have a divider 902 between the lateral sides 118, the inner side 114 and the outer side 116 as shown in FIG. 9. The divider 903 creates a multiple sealed compartments.

In one embodiment, the LED light module 102 may also provide uplight. That is to say that the LED light module 102 can provide light downward and upward. In other words, a second set of LEDs 162 may be positioned to emit light in a direction 180 degrees from a first set of LEDs 162. For example the back plate 180 may be replaced by a second optically clear cover 182 and PCB 160. A second optic layer 154 may also be utilized. This allows a bidirectional light for both downlight and uptight.

In a further embodiment, the LED light module 102 may comprise light sections 106 that are directed downward as well as light sections 106 that are directed upward. In other words, the LED light module 102 may comprise one or more light sections 106 wherein the light concentration is directed about 180 degrees opposite from additional light sections 106.

The ledge 164 may have a first side and a second side opposite the first side. The optically clear cover 182 may be coupled to the modular light section 106 via the first side of the ledge 164 on a bottom portion of the modular light section 106. For example, the bottom portion may be a side in which light is emitted from the LEDs 162 when the light apparatus 100 is installed. The optically clear cover 182 may be placed over the PCB 160 and the optic layer 154. In addition, the ledge 164 is positioned such that the one or more LEDs 162 on the PCB 160 are as close to the optically clear cover 182 or the bottom portion as possible. The deeper the LEDs 162 on the PCB 160 are located in the modular light section 106 (e.g., closer to the back plate 180) the less effectively light is emitted from the LEDs 162. For example, when the LEDs 162 on the PCB 160 are located too deep in the modular light section 106, the light emitted from the LEDs 162 has difficulty escaping the cavity and out towards the optically clear cover 182.

As a result, placing the LEDs 162 on the PCB 160 as close to the bottom portion as possible improves the optical performance of the light apparatus 100. The optically clear cover 182 may be an optically clear plastic or glass. In one embodiment, the optically clear cover 182 may include optical features that help to refract the light emitted by the LEDs 162.

The back plate 180 may be coupled to the modular light section 106 via the second side of the ledge 164 that is located opposite the first side of the ledge 164. In one embodiment, the back plate 180 may be fabricated from a conductive metal, e.g., aluminum, copper, and the like, similar to the modular light section 106 and associated heat sink fins 108. The back plate 180 radiates heat away from the LEDs 162 via emissivity of the metal, in addition to the heat sink fins 108 that conduct heat away from the LEDs 162. In one embodiment, an air pocket may be present between the back plate 180 and the PCB 160. In one embodiment, at least 80% of the back surface of the PCB 160 is exposed to air. For example, the air pocket may be designed to a volume that has a height that is approximately the height of the heat spread fins 190. In one embodiment, the air pocket may be filled with a filler material that may conduct heat between the back plate 180 and the PCB 160. In other words, the volume may be filled with a filler material to conduct heat to the back plate 180. In one embodiment, at least 80% of the back surface of the PCB 160 is exposed to the filler material.

The PCB 160 with the one or more LEDs 162 and the optic layer 154 may be placed onto the inner ledge 172 and secured via one or more mechanical fasteners 110, illustrated in FIG. 6, that is fitted through one or more openings 166 on the modular light section 106, one or more openings 168 on the PCB 160 and one or more openings 158 on the optic layer 154 that are aligned.

The shape of the PCB 160, the optic layer 154, the back plate 164 and the optically clear cover 182 provide advantages in cost savings and efficiency of manufacturing. For example, the PCB 160, the optic layer 154, the back plate 164 and the optically clear cover 182 may be fabricated from a single diagonal cut of a rectangular or square sheet. As a result, less material is wasted and associated costs with wasted material are minimized.

In one embodiment, the modular light section 106 may include one or more interlocking features 150 and 152 to connect adjacent modular light sections 106. In one embodiment, the interlocking feature 150 may be a male C-shaped feature and the interlocking feature 152 may be a female C-shaped feature. The male C-shaped feature and the female C-shaped feature may be used to connect adjacent modular light sections 106 and to provide an opening for the mechanical fasteners 110 and plates 134, illustrated in FIG. 6, to secure the modular light sections 106 together. For example, the female C-shaped feature may slide into a male C-shaped feature of an adjacent modular light section 106 in a concentric fashion. Although the interlocking features 150 and 152 are illustrated as C-shaped features, it should be noted that any type of mechanical interlocking feature may be used to connect adjacent modular light sections 106 together.

In one embodiment, two or more modular light sections 106 may form a "single" modular light section 106. For example, a single modular light section 106 may include two separate PCBs 160 with two different arrays of LEDs 162, two separate back plates 164, and the like. As a result, if six light sections are need for the LED light module 102, then only three modular light sections 106 may need to be coupled together. For example, extruding two or more modular light sections 106 as a single piece may improve manufacturing and assembly times of the LED light module 102.

As noted above, the modular light section 106 also includes heat sink fins 108 on an inside of the lateral sides 118. In one embodiment, additional heat sink fins 108 may be added on a side of an inner cross section 174. The inner cross section 174 may help form part of the inner ledge 172 and the ledge 164.

The power input to the LEDs 162 is mostly lost as heat. For example, only about 25% to 50% of the power input to the LEDs available today is converted to light. The remaining 75% to 50%, respectively, generates heat that must be dissipated. Thus, for high light output applications a large amount of surface area is needed to dissipate the heat from the LEDs to maintain the proper temperature of the LEDs and, therefore, the reliability and operation of the LEDs. Thus, the open frame structure of the modular light section 106 provides an open fixture design for air to pass uninhibited as well as a vast amount of surface area for dissipating heat from the LEDs 162 via the heat sink fins 108. In addition, the surface areas of the heat sink fins 108 are all near the source of the heat, i.e., the LEDs 162. In addition, the back plate 164 radiates heat away from the LEDs 162 as well. Consequently, the overall design of the light apparatus 100 may be relatively small and light weight compared to currently available designs for producing a high light output.

In one embodiment, the outer side 116 may also be referred to as a band member. For example, the outer side 116 may be a solid curved surface that has a height 140 at least as high as the heat sink fins 108. The band member may help protect the heat sink fins 108 from damage while being transported, handled or installed. For example, without the band member, the heat sink fins 108 may be bent, broken, deformed, and the like. The outer side 116 serving as the band member helps to provide added stability and protection for the heat sink fins 108.

As noted above, the design of the light apparatus 100 of the present disclosure provides a more scalable design than currently available designs. For example, current designs have the LED light sources in a center of the light engine that is then surrounded by the heat sink fins. Thus, when LED lights are added, the LEDs are added to a center portion of the light engine, the only way to increase the surface area of the heat sink fins is to radially extend the heat sink fins.

In contrast, the design of the light apparatus 100 moves the LED lights 152 to an outer portions (e.g., the light sections 106) of the light apparatus 100 that can be radially extended outward as more LED lights 152 need to be added. As a result, additional heat sink fins 108 may be added near the added LED lights 152 along a length of the extended lateral sides 118. Thus, effectiveness of the heat sink fins 108 is maintained.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A light emitting diode (LED) light module, comprising:

a plurality of light sections, wherein each one of the plurality of light sections comprises:

a plurality of heat sink fins on an outside of each one of two or more lateral sides from an outer side to an inner side;

a plurality of heat spreader fins on an inside of each one of the two or more lateral sides from the outer side to the inner side;

a compartment formed by the two or more lateral sides, the outer side and the inner side;

a plurality of light emitting diodes (LEDs) inside the compartment, wherein the compartment is sealed from outside air and encloses the plurality of LEDs;

an open volume adjacent to at least three sides;

an inner ledge along an inside perimeter comprising the plurality of heat spreader fins;

a printed circuit board (PCB) comprising the plurality of LEDs, wherein the PCB is placed on the inner ledge;

an optically clear cover coupled perpendicular to a first vertical end of the plurality of heat sink fins over the PCB and the one or more LEDs such that the one or more LEDs emit light towards the optically clear cover; and a back plate coupled perpendicular to a second vertical end of the plurality heat sink fins that is opposite the first vertical end, wherein an air pocket is formed between the PCB and the back plate, wherein a height of the air pocket is approximately equal to a height of the plurality of heat spreader fins; and a plurality of open sections formed by the plurality of heat sink fins between the plurality of light sections that allow air to pass through the plurality of heat sink fins, wherein each one of the plurality of light sections is adjacent to two different light sections of the plurality of light sections.

2. The LED light module of claim 1, wherein 50% or less of a cross sectional area in a plane of the LED light module is open to outside air.

3. The LED light module of claim 1, wherein one or more of the plurality of heat sink fins have an average draft angle of less than six degrees.

4. The LED light module of claim 1, wherein each one of the plurality of light sections comprises a central light output axis, wherein the plurality of heat sink fins and the plurality of heat spreader fins have a constant and projected cross section, wherein the projected cross sections are oriented in an axis parallel to the central light output axis.

5. The LED light module of claim 1, wherein the LED light module comprises six or more of the plurality of light sections.

6. The LED light module of claim 5, wherein each one of the plurality of light sections is each removable.

7. The LED light module of claim 1, wherein an average length of each of the plurality of light sections is greater than an average width of each of the plurality of light sections.

8. The LED light module of claim 7, wherein the width of each of the plurality of light sections increases as the each of the plurality of light sections are radially extended outward.

9. A lighting apparatus comprising:

a center housing; and a plurality of modular light sections coupled to the center housing and to one or more other ones of the plurality of modular light sections, each one of the plurality of modular light sections comprising:

an inner side;

an outer side;

a first lateral side and a second lateral side coupled to the inner side and the outer side;

a plurality of heat sink fins formed on an outside of the first lateral side and the second lateral side;

a plurality of heat spreader fins formed on an inside of the first lateral side and the second lateral side;

a plurality of light emitting diodes (LEDs) inside a compartment formed by the inner side, the outer side, the first lateral side and the second lateral side and on the plurality of heat spreader fins, wherein the compartment is sealed from outside air and encloses the plurality of LEDs;

an interlocking feature on the first lateral side and on the second lateral side;

an inner ledge along an inside perimeter comprising the plurality of heat spreader fins;

a printed circuit board (PCB) comprising the plurality of LEDs, wherein the PCB is placed on the inner ledge;

an optically clear cover coupled perpendicular to a first vertical end of the plurality of heat sink fins over the PCB and the one or more LEDs such that the one or more LEDs emit light towards the optically clear cover; and a back plate coupled perpendicular to a second vertical end of the plurality heat sink fins that is opposite the first vertical end, wherein an air pocket is formed between the PCB and the back plate, wherein a height of the air pocket is approximately equal to a height of the plurality of heat spreader fins.

10. The lighting apparatus of claim 9, wherein a respective plurality heat sink fins of two adjacent modular light sections is approximately aligned to form an open section between the two adjacent modular light sections.

11. The lighting apparatus of claim 9, wherein each one of the plurality of modular light sections comprises a central light output axis, wherein the plurality of heat sink fins and the plurality of heat spreader fins have a constant and projected cross section, wherein the projected cross sections are oriented in an axis parallel to the central light output axis.

12. The lighting apparatus of claim 9, wherein one or more of the plurality of heat sink fins have an average draft angle of less than six degrees.

13. A light module section for connecting to other light module sections to form a lighting apparatus, comprising:

a plurality of heat sink fins on an outside of each one of two or more lateral sides;

a plurality of heat spreader fins on an inside of the each one of the two or more lateral sides;

an inner ledge formed by the plurality of heat spreader fins along an inner perimeter of the two or more lateral sides;

a printed circuit board (PCB) comprising one or more light emitting diodes (LEDs), wherein the PCB is placed on the inner ledge of a compartment formed by an inner side, an outer side and the two or more lateral sides, wherein the compartment is sealed from outside air and encloses the plurality of LEDs;

an optically clear cover coupled perpendicular to a first vertical end of the plurality of heat sink fins over the PCB and the one or more LEDs such that the one or more LEDs emit light towards the optically clear cover; and a back plate coupled perpendicular to a second vertical end of the plurality heat sink fins that is opposite the first vertical end, wherein an air pocket is formed between the PCB and the back plate, wherein a height of the air pocket is approximately equal to a height of the plurality of heat spreader fins.

14. The light module section of claim 13, wherein the light module section is coupled to other light module sections to form the lighting apparatus comprising six or more light module sections.

15. The light module section of claim 14, wherein the light module section is connected to the other light module sections forming a circle with a center opening.

16. The light module section of claim 14, wherein the light module sections are connected linearly.

* * * * *